US008849171B2

(12) United States Patent
Dedic et al.

(10) Patent No.: US 8,849,171 B2
(45) Date of Patent: Sep. 30, 2014

(54) DEVICE AND METHOD TO FIX PRINT IMAGES WITH A POROUS BURNER IN A DRYING CHAMBER

(75) Inventors: Revdin Dedic, Markt Schwaben (DE); Stefan Roehl, Munich (DE)

(73) Assignee: Océ Printing Systems GmbH, Poing (DE)

( * ) Notice: Subject to any disclaimer, the term of this patent is extended or adjusted under 35 U.S.C. 154(b) by 699 days.

(21) Appl. No.: 13/151,321

(22) Filed: Jun. 2, 2011

(65) Prior Publication Data

US 2011/0299905 A1 Dec. 8, 2011

(30) Foreign Application Priority Data

Jun. 4, 2010 (DE) ..... 10 2010 017 239

(51) Int. Cl.

| | |
|---|---|
| ***G03G 15/20*** | (2006.01) |
| ***B41F 23/04*** | (2006.01) |
| *F26B 3/28* | (2006.01) |
| *F26B 3/30* | (2006.01) |

(52) U.S. Cl.

CPC ..... *G03G 15/2007* (2013.01); *G03G 15/201* (2013.01); *B41F 23/0403* (2013.01); *F26B 3/283* (2013.01); *B41F 23/0436* (2013.01); *F26B 3/305* (2013.01); *G03G 15/2053* (2013.01); *F26B 3/30* (2013.01)

USPC ..... 399/336; 399/337; 34/266; 34/267; 34/268; 34/269; 430/124.4; 431/5; 431/7; 431/326; 219/216

(58) Field of Classification Search

CPC .... G03G 15/2007; G03G 15/201; F26B 3/30; F26B 3/305

USPC ..... 399/336, 337; 430/124.4

See application file for complete search history.

(56) References Cited

U.S. PATENT DOCUMENTS 4,340,028 A * 7/1982 Hatta et al. ..... 126/92 R
4,406,611 A * 9/1983 Michel ..... 431/12

(Continued)

FOREIGN PATENT DOCUMENTS

DE 3811620 A1 10/1989
DE 3939190 A1 8/1990

(Continued)

OTHER PUBLICATIONS

English machine translation of DE 10 2006 012940 B3;"Toner image fixing device for e.g. copying machine, has fixing station comprising gas burner, where heat energy is produced from gas flame of burner and is directed on toner pictures and recording medium"; published Sep. 27, 2007; by Bogdan,Attila; Scherdel,Stefan; Viechter,Manfred.*

*Primary Examiner* — David Gray
*Assistant Examiner* — Geoffrey Evans
(74) *Attorney, Agent, or Firm* — Schiff Hardin LLP

(57) ABSTRACT

In a device or method to fix print images on a recording material, a printing fluid comprising a carrier fluid and chromophoric solid particles are applied to the recording material, the chromophoric solid particles being applied in a form of the print images to be fixed. Hot waste gas and infrared radiation are generated with aid of a porous burner. The infrared radiation is directed towards the recording material in a drying chamber such that the carrier fluid polymerizes or is vaporized, whereby a gaseous air/oil mixture arises in the drying chamber. The air/oil mixture is influenced with aid of the hot waste gas of the porous burner.

14 Claims, 4 Drawing Sheets

(56) References Cited

U.S. PATENT DOCUMENTS

| | | | | |
|---|---|---|---|---|
| 4,745,432 | A * | 5/1988 | Langdon | 399/250 |
| 4,952,145 | A | 8/1990 | Kwiatkowski et al. | |
| 5,060,572 | A | 10/1991 | Waizmann | |
| 5,249,953 | A | 10/1993 | Roth | |
| 5,537,925 | A | 7/1996 | Secor et al. | |
| 5,737,674 | A * | 4/1998 | Venkatesan et al. | 399/250 |
| 6,427,594 | B1 | 8/2002 | Secor et al. | |
| 7,245,866 | B2 * | 7/2007 | Frohlich | 399/341 |
| 8,672,469 | B1 * | 3/2014 | Walker et al. | 347/102 |
| 2001/0015746 | A1 * | 8/2001 | Yosimura et al. | 347/102 |
| 2009/0148620 | A1 | 6/2009 | Petermann | |
| 2014/0119793 | A1 * | 5/2014 | Yoshikado et al. | 399/336 |

FOREIGN PATENT DOCUMENTS

| | | | |
|---|---|---|---|
| DE | 69415443 | T2 | 3/1995 |
| DE | 102006012940 | B3 | 9/2007 |
| DE | 102007058957 | A1 | 6/2009 |
| DE | 102008000010 | A1 | 7/2009 |

* cited by examiner

DEVICE AND METHOD TO FIX PRINT IMAGES WITH A POROUS BURNER IN A DRYING CHAMBER

BACKGROUND

The preferred embodiment concerns a method and a device to fix print images on a recording material.

For single-color or multicolor printing of a recording material, for example of a single page or of a belt-shaped recording material made of the most varied materials (for example plastic, paper or thin metal films), it is generally known: to generate image-dependent potential images (charge images) on a potential image carrier, for example a photoconductor; to ink these in a developer station (inking station); and to transfer-print the image developed in such a manner on the recording material. To develop the potential images it is known to apply printing fluid to the recording material in an electrophoretic method. It is also known to transfer-print images onto a recording material via rollers and a printing plate in an offset printing method.

The printing fluid is a liquid developer in digital printing or oil-based ink in offset printing. For example, the printing ink has silicone oil, mineral oil and/or a liquid that can be photopolymerized (the fluid being designated as carrier fluid) and toner particles, color pigments and/or dyes which are chromophoric solid particles. Moreover, additional substances can be added to the carrier fluid, for example fountain solution, charge control substances, initiators and/or agents affecting the surface tension or viscosity.

The print images are transfer-printed onto the recording material with the chromophoric solid particles. In contrast to this, the carrier fluid is required to (among other things) transfer the solid particles to the potential image carrier, the rollers, the print plate or the recording material and can be distributed over the entire width of the recording material, independent of the print images. In the fixing of the applied image, the carrier fluid applied to the recording material is vaporized in a drying chamber connected to a printer. The chromophoric solid particles applied to the recording material are fused upon fixing the print images after the vaporization of the carrier fluid and thereby bond with the recording material. Other printing fluids are also known in which, upon heating, the carrier fluid polymerizes in a cross-linking manner such that it fixes the chromophoric solid particles in their position, wherein solid particles can thereby be used that do not fuse upon being heated. In offset printing the oil-based ink (comprised of carrier fluid and dye pigments) is initially transfer-printed onto the recording material and partially penetrates into the pores of the recording material. The carrier fluid is subsequently vaporized.

For example, the fusing of the chromophoric solid particles, the vaporization of the carrier fluid or the polymerization of the carrier fluid takes place with the aid of infrared radiation, flash fixing, heat-pressure rollers, or hot air. An air/oil mixture forms in the drying chamber due to the vaporized carrier fluid, in particular vaporized oil. In the fixing of the print images the recording material is heated to temperatures between 90 and 160 degrees Celsius and the air/oil mixture is heated to temperatures up to 300 degrees Celsius. With increasing operation duration of the drying chamber, the concentration of the vaporized carrier fluid (and therefore the oil ratio in the air/oil mixture) also increases. The concentration of the vaporized carrier fluid in the air/oil mixture can thus be so high that an acute explosion risk exists. The lower limit of the concentration as of which an acute explosion risk exists is also called the lower explosion limit (LEL). The air/oil mixture is regularly thinned with fresh air so that the LEL is not exceeded. A further variable that has an effect on the explosion risk is the temperature of the air/oil mixture. A cooling of the air/oil mixture is avoided in that the fresh air is preheated, for example with a hot air dryer. The air/oil mixture must be recycled (which is expensive and complicated) in that the oil portion is removed from the air/oil mixture.

SUMMARY

It is an object to achieve a device and a method to fix print images on a recording material, which device and method enable an energy-efficient fixing of the print images in a simple manner.

In a device or method to fix print images on a recording material, a printing fluid comprising a carrier fluid and chromophoric solid particles are applied to the recording material, the chromophoric solid particles being applied in a form of the print images to be fixed. Hot waste gas and infrared radiation are generated with aid of a porous burner. The infrared radiation is directed towards the recording material in a drying chamber such that the carrier fluid polymerizes or is vaporized, whereby a gaseous air/oil mixture arises in the drying chamber. The air/oil mixture is influenced with aid of the hot waste gas of the porous burner.

DESCRIPTION OF THE PREFERRED EMBODIMENT

Figure 1:
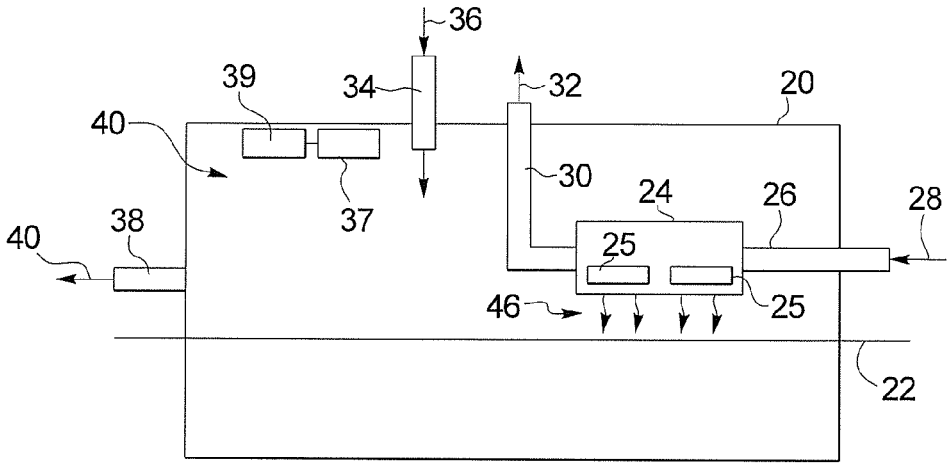
FIG. 1 is a sectioned side view of a drying chamber of a printer.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

According to a first aspect of the preferred embodiment, a drying chamber is provided with a porous burner. A recording material on which a printing fluid (comprising carrier fluid particles and chromophoric solid particles) is applied and is located at least partially in the drying chamber. The chromophoric solid particles are applied to the recording material in the form of the print images. The porous burner generates hot waste gas and infrared radiation of the porous burner and is arranged in the drying chamber so that the infrared radiation of the porous burner is directed towards the recording material. The carrier fluid of the printing fluid vaporizes (whereby a gaseous air/oil mixture arises in the drying chamber) or the carrier fluid polymerizes. The hot waste gas of the porous burner affects various parameters of the air/oil mixture in the drying chamber.

The use of the infrared radiation contributes to the particularly energy-efficient fixing of the print images since the power density of the infrared radiation is relatively high compared with other methods to fix print images. The additional usage of the hot waste gas of the porous burner to affect the air/oil mixture likewise contributes to the particularly energy-efficient fixing of the print images since the entirety of the heat energy generated by the porous burner (which heat energy is comprised of the infrared radiation and the hot waste gas) is thereby utilized to fix the print images. Given use of liquid developer as a printing fluid, the chromophoric solid particles can fuse and/or the liquid developer can be polymerized. Given use of oil-based ink as a printing fluid, the carrier fluid for the most part polymerizes and the color pigments bind with the recording material.

The porous burner is a gas burner in which a combustion reaction of a fuel reaction of a fuel/air mixture runs into a porous structure and not into an open flame, as in other gas burners. The porous burner frequently comprises a hardened foam, in particular a ceramic foam.

In an advantageous embodiment, a heat exchanger is coupled with the porous burner and the drying chamber to affect the air/oil mixture. With the aid of the hot waste gas of the porous burner, the heat exchanger heats the air/oil mixture in the drying chamber or heats fresh air to thin the air/oil mixture before it is supplied into the drying chamber. This enables the air/oil mixture to be heated in the drying chamber, or the fresh air to be heated, so that the temperature of the air/oil mixture contributes to the fixing of the print images, or enables that the fresh air does not unnecessarily severely cool the air/oil mixture upon thinning of the air/oil mixture with fresh air, but rather that the fresh air is already preheated upon being mixed with the air/oil mixture.

The air/oil mixture is comprised of the air in the drying chamber and the vaporized carrier fluid which essentially is comprised of aerosol (gas and droplets). The concentration of the vaporized carrier fluid refers to the proportion of the gaseous oil in the air/oil mixture. The more carrier fluid that vaporizes, the higher the concentration of oil in the air/oil mixture insofar as the system is closed and nothing is supplied or discharged otherwise. Upon thinning the air/oil mixture, given a constant total volume fresh air is supplied to the air/oil mixture and at the same time a portion of the air/oil mixture is discharged, which reduces the portion of the vaporized carrier fluid in the air/oil mixture and thus reduces the concentration of the vaporized carrier fluid in the air/oil mixture.

As an alternative or in addition to the heat exchanger, an air mixer is coupled with the porous burner and the drying chamber to affect the air/oil mixture, which air mixer mixes the air/oil mixture or the fresh air with the hot waste gas to thin the air/oil mixture. Like the heat exchanger, the air mixture contributes to the energy-efficient fixing of the print images, wherein the direct mixing of the hot waste gas with the fresh air promotes a high degree of efficiency in the fixing of the print images since the fresh air is heated by the waste gas.

In a further advantageous embodiment, a sensor device is provided that detects a real value of at least one parameter of the air/oil mixture. With the aid of the hot waste gas of the porous burner, a control device affects the air/oil mixture depending on the detected real value such that the real value approximates a desired value of the parameter or corresponds to this. For example, the parameter can be the concentration of vaporized carrier fluid, in particular oil particles in the air/oil mixture. The detection of the real value of the concentration and the approximation of the real value to the desired value can thus contribute to keeping the concentration of the air/oil mixture from becoming so high that the UEG is exceeded and the air/oil mixture can easily ignite. As an alternative or additional parameter, the temperature of the air/oil mixture can also be detected and regulated.

The porous burner can be operated particularly economically in that a gas return is coupled with the drying chamber and the porous burner, which gas return supplies at least a portion of the air/oil mixture from the drying chamber to the porous burner as an additional fuel/air mixture. The fact is thereby utilized that the carrier fluid comprises regularly flammable components which can be used in vaporized form as a fuel/air mixture. In particular, the gaseous air/oil mixture comprises the oil particles of the carrier fluid. For example, the portion of the air/oil mixture can be extracted from the total air/oil mixture in that the air/oil mixture is drawn out of the drying chamber and the oil is extracted from the suctioned air/oil mixture, or at least the air portion of the suctioned air/oil mixture is reduced so that the concentration of the remaining air/oil mixture is so high that it is suitable as a fuel/air mixture.

According to a second aspect, the preferred embodiment is characterized by a method to fix print images on the recording material. Hot waste gas and infrared radiation are generated with the aid of the porous burner. The infrared radiation is directed towards the recording material. The carrier fluid of the printing fluid is vaporized, whereby the gaseous air/oil mixture is created in the drying chamber. The air/oil mixture is affected with the aid of the hot waste gas of the porous burner.

The method to fix the print images enables the print images to be fixed particularly energy-efficiently, in particular in that with the aid of the hot waste gas the air/oil mixture or fresh air to thin the air/oil mixture is heated before the thinning, or the hot waste gas is mixed with the air/oil mixture or the fresh air to affect the air/oil mixture. It is thereby particularly advantageous when a real value of the parameter—in particular the temperature and/or the proportion of the vaporous carrier fluid in the air/oil mixture—is detected and the air/oil mixture is affected with the aid of the hot waste gas, depending on the detected real value.

Exemplary embodiments are explained in the following using schematic drawings.

Elements of identical construction or function are identified with the same reference characters across the drawing figures.

FIG. 1 shows a drying chamber 20 that is connected to a printer (not shown). In the printer a recording material 22 is printed with a print image. The recording material 22 is introduced into the drying chamber 20 via a first slit (not shown), moves through the drying chamber 20, and is directed out of the drying chamber 20 via a second slit (not shown). To fix the print image, the drying chamber 20 has a porous burner 24.

The porous burner 24 comprises one, two, or more modules 25 and is coupled at the input with a fuel feed 26 and at the output with a waste gas discharge 30. The modules 25 comprise porous structures. The drying chamber 20 has an air feed 34 and a gas outlet 38. A sensor device 39 and a control device 37 are also arranged, wherein the latter is coupled with the porous burner 24 and different control elements (not shown), in particular valves. Fresh air 36 is supplied to the drying chamber 20 via the air feed 34. The gas outlet 38 serves to discharge an air/oil mixture 40 that forms in the drying chamber 20.

The porous burner 24 generates infrared radiation 46 that radiates in the direction of the recording material 22. In addition to the infrared beam 46, the porous burner 24 generates hot waste gas 32 that is diverted from the porous burner 24 with the aid of the waste gas discharge 30. The porous burner 24 is operated with the aid of a fuel/air mixture 28 that is supplied to the porous burner 24 via the fuel feed 26. An air/gas mixture is suitable as a fuel/air mixture 28, wherein gaseous oil, propane or natural gas or oil droplets mixed with air can be used as a gas, for example. The heating capacity of the porous burner 24 is distributed between the infrared radiation 46 and the hot waste gas 32, wherein approximately 30% of the heating capacity is generated by the infrared radiation 46 and 70% of the heating capacity is generated by the hot waste gas 32, wherein the heating capacity of the hot waste gas 32 is used in order to affect the air/oil mixture 40 in the drying chamber 20.

As a heating element the porous burner 24 has a porous structure (not shown), for example a foam structure in which the combustion of the fuel/air mixture 28 proceeds and that is divided into one, two, or more modules 25. The modules 25—in particular the porous structure of the modules 25—can be of nearly arbitrary design, whereby heating elements of different shape can be designed. Among other things, this enables different heating gradients to be realized. For example, a faster temperature rise (and therefore a relatively large heating gradient) can be produced by a large-area module or multiple modules packed close to one another, assuming the movement of the recording material 22 through the drying chamber. In contrast to this, a slower temperature rise (and therefore a small heating gradient) can be produced in that one or more smaller modules are connected in series so that regions in which no infrared radiation 46 is generated arise between the active modules.

The low-emission, hot waste gas 32 of the porous burner 24 has barely any of the fuel/air mixture 28 since the fuel has largely combusted. The low-emission, hot waste gas 32 can reach temperatures of over 1400 degrees Celsius. A capacity range of the porous burner 24 is relatively large compared with other gas burners. This means that a very low heating capacity (for example a few kilowatt) up to a very high heating capacity (for example 400 to 500 kilowatt) can be achieved with the porous burner 24. This ensures a large regulation tolerance in fixing the print images to the recording material 22.

The control device 37 and a sensor device 39 are provided to detect a parameter of the air/oil mixture 40, for example the concentration or the temperature of the air/oil mixture 40. The sensor device 39 is suitable to detect a real value of the parameter and the control device 37 to compare the real value of the parameter with a desired value of the parameter and to activate suitable control elements whose setting affects the respective parameter of the air/oil mixture 40. The parameter is an arbitrary parameter of the air/oil mixture 40, advantageously a concentration of the oil in the air/oil mixture 40. Alternatively or additionally, the temperature of the air/oil mixture 40 can also be monitored as a parameter of the air/oil mixture 40.

Figure 2:
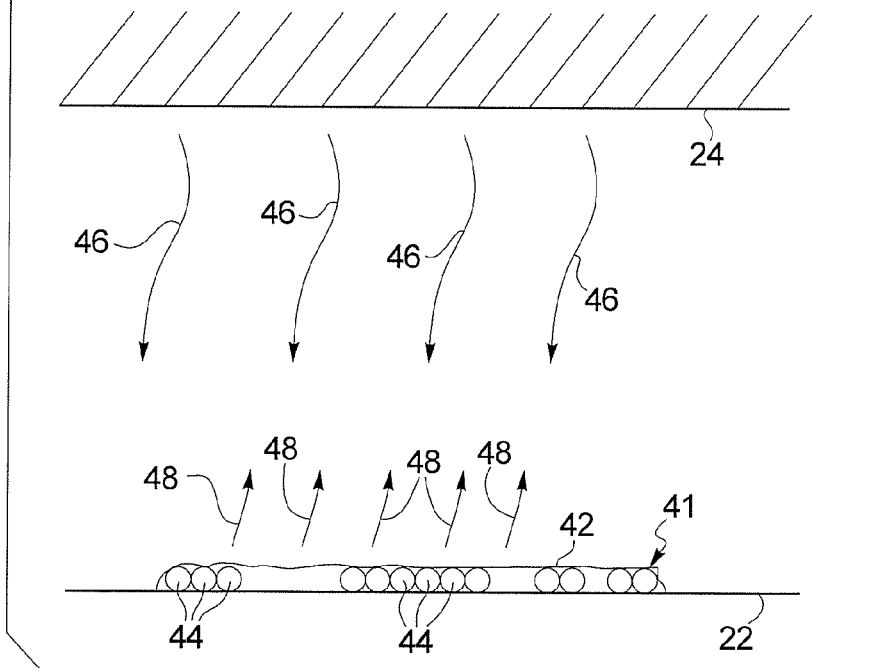
FIG. 2 is a detail view of the drying chamber according to FIG. 1.

FIG. 2 shows a detail view of the drying chamber 20 according to FIG. 1 that shows an enlarged section of the recording material 22 and the porous burner 24. In the enlarged presentation it is that a printing fluid 41—in particular a liquid developer or oil-based ink—is applied to the recording material 22. The printing fluid 41 comprises a carrier fluid 42 (which comprises mineral oil or silicone oil, for example) and chromophoric solid particles, in particular dye pigments or toner particles 44 that, for reasons of clarity, are only partially identified with reference characters. The dye pigments or toner particles 44 form the print image and are only located at image areas on the recording material 22. The toner particles are shown enlarged in FIG. 2 for the sake of a better presentation. The carrier fluid 42 is advantageously transparent and can be distributed over the entire recording material 22, depending on the process. The carrier fluid 42 is required in order to transfer the toner particles 44 to potential image carriers, and possibly to a transfer unit of the printer and to the recording material 22. If the print image is applied to the recording material 22, the carrier fluid 42 applied depending on the process is vaporized and the toner particles 44 are fused, wherein the fused resin of the toner particles 44 is bonded with the recording material 22, or the carrier fluid 42 is polymerized, whereby it cross-links and the chromophoric solid particles are fixed in their position. In the latter case, solid particles can be used that do not fuse upon being fixed.

Starting from the porous burner 24, the infrared radiation 46 is directed towards the recording material 22. The infrared radiation 46 has the effect that the carrier fluid 42 vaporizes and that the toner particles 44 fuse and bond with the recording material 22. Carrier fluid 48 vaporized from the printing fluid 41 forms the gaseous or fog-like portion of oil in the air/oil mixture 40. The more carrier fluid 42 that is vaporized, the greater the oil proportion in the air/oil mixture 40. The porous burner 24 is advantageously used as a laminar radiation source for the vaporization of the carrier fluid 42 of the printing fluid 41 and the heating of the recording material 22, such that at least the entire printable surface of the recording material 22 is uniformly heated.

The vaporized carrier fluid 48 comprises oil molecules or droplet-shaped oil that, together with the air located in the drying chamber 20, form the air/oil mixture 40. The fixing of the print image with the aid of the infrared radiation 46 is particularly energy-efficient since the efficiency of the fixing of the print image with the aid of infrared radiation 46 is particularly high due to the high energy density of the infrared radiation 46, compared with other methods for fixing the print images.

To fix the print image, the recording material 22 is heated to a maximum of 160° and the air/oil mixture 40 is heated to a maximum of 300° Celsius, to which the hot waste gas 32 can also contribute, as is explained further below. For this two different, complementary control loops can be used in cooperation or individually, independent of one another, wherein in a first control loop the temperature of the air/oil mixture 40 is detected and regulated and the temperature of the recording material 22 is adjusted depending on this, and wherein in a second control loop the temperature of the recording material 22 is detected and the temperature of the air/oil mixture 40 is concluded and this is regulated so that the temperature at the recording material 22 lies in a desired range. The fixing process can thereby be additionally improved in that a turbulent air flow is generated between porous burner 24 and recording material 22, such that the air/oil mixture 40 advantageously sweeps over the printing fluid 41 applied to the recording material 22 since this additionally assists the effect of the infrared radiation 46. For example, the turbulent air mixture can be generated via targeted blowing of hot, fresh air.

Among other things, with the aid of the adjustable heating gradient the modular design of the porous burner 24 enables a realization of temperature profiles accelerating the fixing of the print images (which temperature profiles produce different heating gradients) and/or an adaptation to different widths of the recording material 22. For example, multiple modules 24 can be arranged transversal to the movement direction of the recording material 22 and in particular over the entire width of the recording material 22. Which of these modules 24 arranged transverse to the movement direction are used for fixing is decided individually, depending on the width of the recording material 22 and/or the width of the printable region of the recording material 22. The modular design can additionally be used for a targeted fixing of print images with different colors since different colors of toner particles 44 can normally fuse at different speeds, or different carrier fluids 42 can polymerize at different speeds. Depending on which ink is used, one, two or more modules 25 arranged in series in the movement direction of the recording material 22 can be activated or deactivated. The capacity of one of the modules 25 thereby respectively determines the generated infrared spectrum, in contrast to which the number of modules 25 determines the total heating capacity of the porous burner 24.

The entire fixing process is designed to be more energy-efficient in that—as an alternative to in addition to the conventional fuel/air mixture 28—at least a portion of the air/oil mixture 40 is supplied back from the drying chamber 20 to the porous burner 24 as a fuel/air mixture 28. For example, a portion of the air/oil mixture 40 can initially be drawn off via the gas outlet 38. An additional portion of the air/oil mixture can be extracted from the drawn-off portion of the air/oil mixture 40, for example by extracting the vaporized carrier fluid 48 from the drawn-off portion of the air/oil mixture 40 or by concentrating the drawn-off portion of the air/oil mixture 40. The extracted carrier fluid 42 or the concentrated air/oil mixture 40 can then be used as a fuel/air mixture 28 and/or be mixed with the fuel/air mixture 28 and can then be supplied to the porous burner 24.

Figure 3:
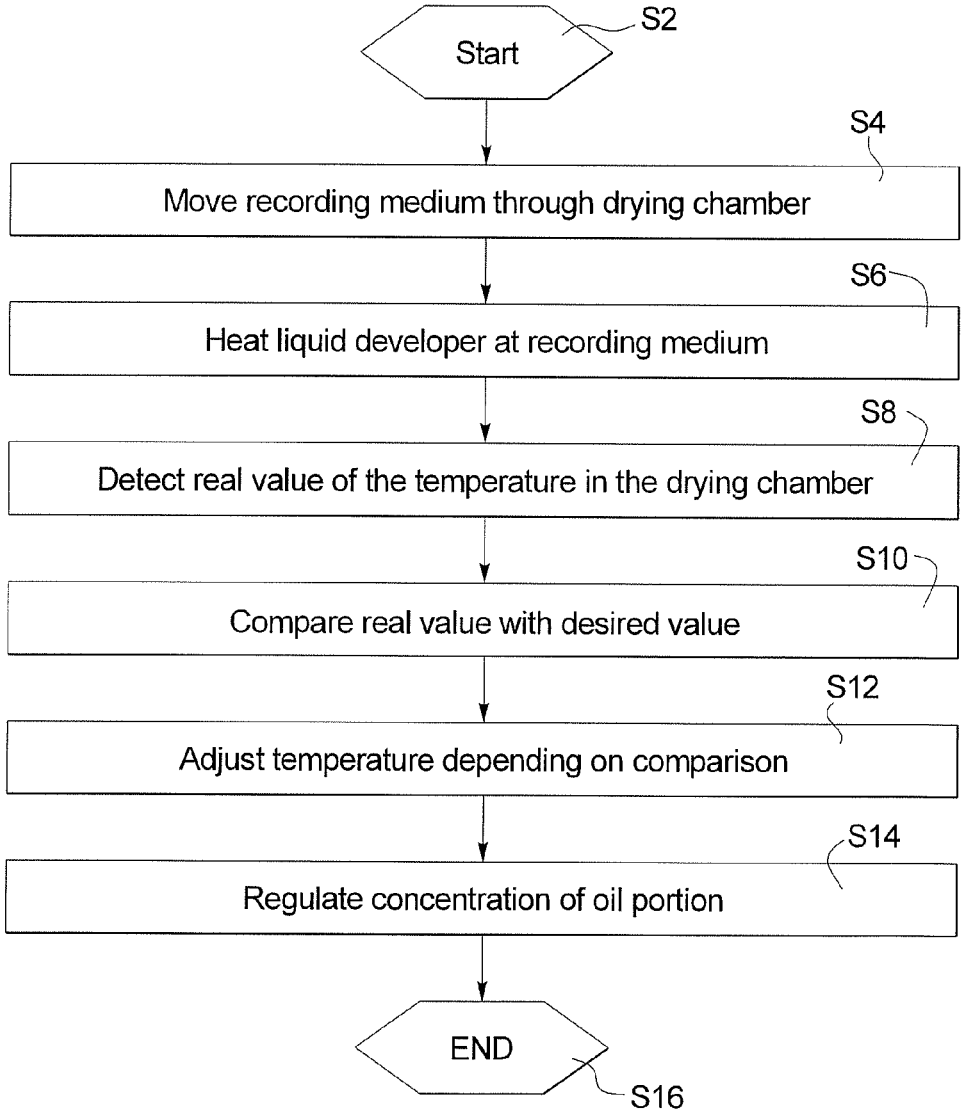
FIG. 3 is a workflow diagram of a method to fix print images on a recording material.

FIG. 3 shows a workflow diagram of a method to fix the print image on the recording material 22. The method serves to fix the print image on the recording material 22 in a particularly energy-efficient manner, in particular to vaporize the carrier fluid 42 and to fuse the toner particles 44 or to polymerize the carrier fluid 42 in a cross-linked manner such that it fixes the chromophoric solid particles to the recording material 22. The method is started in Step S2.

In Step S4 the recording material 22 freshly printed with printing fluid 41 is introduced into the drying chamber 20 via one of the slits of the drying chamber 20 and is moved through said drying chamber 20.

In Step S6 the printing fluid 41 on the recording material 20 is heated in the drying chamber 20 with the aid of the infrared radiation 46 and the warm air/oil mixture 40. The infrared radiation 46 not only heats the printing fluid 41 on the recording material 20 but also the recording material 20 itself and the air/oil mixture 40 in the drying chamber 20.

In Step S8 a real value of a temperature in the drying chamber 20 is detected. The temperature in the drying chamber 20 can be the temperature of the recording material 20 and/or the temperature of the air/oil mixture 40. In other words, either the real value of the temperature of the recording material 20 or the real value of the temperature of the air/oil mixture 40—or the real values of both temperatures—can be detected.

In Step S10, the detected real value or values are compared with corresponding desired values.

In Step S12 the temperature of the recording material 20 or of the air/oil mixture 40 is set depending on the comparison in Step S10. For example, the setting of the corresponding temperature can take place by adjusting the heating capacity of the porous burner 24. The heating capacity of the porous burner 24 can be set via the amount of fuel/air mixture 28 supplied per time unit. The supplied amount of fuel/air mixture 28 directly affects the heating capacity of the infrared radiation 46 and the hot waste gas 32. The infrared radiation 46 directly affects the recording material 22 with the printing fluid 41 and the air/oil mixture 40 in the drying chamber 20. The effect of the hot waste gas 32 on the recording material 22 with the printing fluid 41 and the air/oil mixture 40 in the drying chamber 20 can be influenced in that the amount of hot waste gas 32 with which the air/oil mixture 40 or the fresh air 36 is heated can be set, wherein the temperature of the hot waste gas 32 is taken into account.

Figure 4:
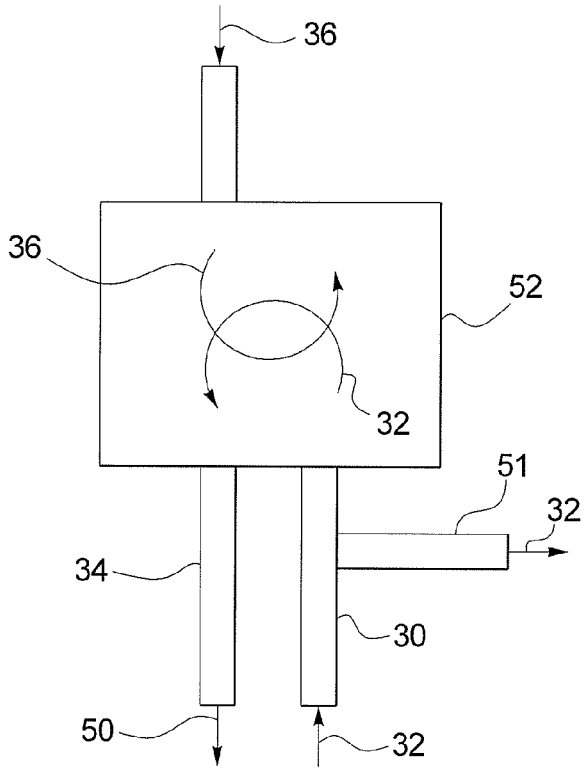
FIG. 4 is an air mixer.
Figure 5:
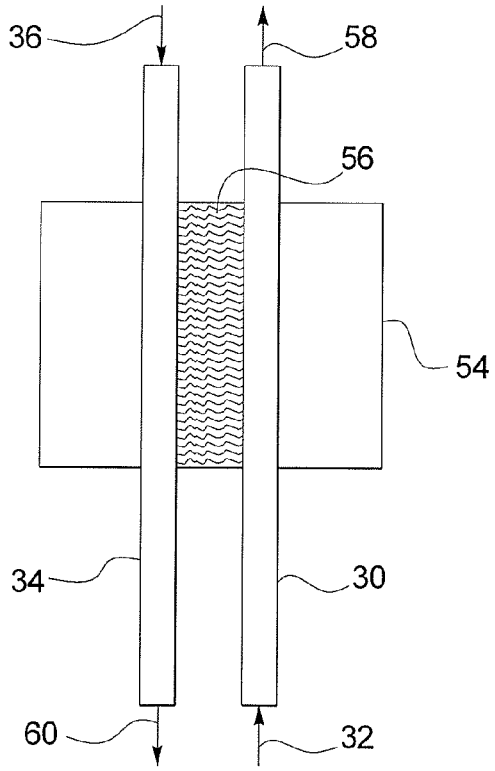
FIG. 5 is a heat exchanger.

To influence the air/oil mixture 40 or the fresh air 36 with the aid of the hot waste gas 32, the hot waste gas 32 is mixed with the fresh air 36 in an air mixer 52 (shown in FIG. 4). The air mixer 52 is coupled with the hot air discharge 30. The air mixer 52 has a relief device 51 with a control element (not shown), in particular a valve, with whose help the hot waste gas 32 can be emitted to the surroundings before entering into the air mixer 52. The relief device 51 enables the hot waste gas 32 to be supplied in doses to the air mixer 52. Fresh air 50 mixed with the hot waste gas 32 is then added to the air/oil mixture 40 via the air feed 34 which leads into the dry chamber 20, which fresh air 50 is thereby thinned and not unnecessarily significantly cooled or even heated. As an alternative to this, to affect the air/oil mixture 40 or the fresh air 36 with the aid of the hot waste gas 32 the hot waste gas 32 can be supplied via the hot air discharge 30 to a heat exchanger 54 (shown in FIG. 5). In the heat exchanger 54 the hot air discharge 30 is thermally coupled with the air feed 34 via a separating wall 56. In this way the fresh air 36 is heated in the heat exchanger 54 so that heated fresh air 60 can be supplied to the air/oil mixture 40 in the drying chamber 20 via the air feed 34.

In Step S14 the concentration of the oil portion in the air/oil mixture 40 can be regulated, which is further explained in detail using a workflow diagram of a method to regulate the concentration of the oil portion.

The method can be ended in Step S16.

Steps S6 through S12 are advantageously executed in the form of a control loop or in the form of two control loops engaging with one another, which control loops regulate the temperature of the recording material 20 or the temperature of the air/oil mixture 40.

After a longer operation of the drying chamber 20, a concentration of the vaporized printing fluid 48 in the air/oil mixture 40 can become so high that the air/oil mixture 40 can easily be ignited. The limit at which the concentration becomes critical can also be designated as a lower explosion limit (LEL). So that the LEL is not exceeded, fresh air 36 must be regularly supplied to the air/oil mixture 40 and thus the air/oil mixture 40 is thinned. So that the concentration of the vaporized carrier fluid 42 in the air/oil mixture 40 does not become too high, in normal operation of the drying chamber 20 relatively large amounts of fresh air must be supplied for thinning. The feed of the fresh air 36 is advantageously regulated. Since fresh air 36 in principle has a lower temperature than the air/oil mixture 40 in the drying chamber 20, the unaffected fresh air would too significantly cool the hot air/oil mixture 40 in the drying chamber 20, which would be disadvantageous to the fixing process. Therefore the hot waste gas 32 is used to heat the fresh air 36 with which the air/oil mixture 40 is influenced. The fresh air 36 can thereby be heated in that it is mixed with the hot waste gas 32 before the thinning of the air/oil mixture 40, or in that the fresh air 36 is merely heated with the aid of the hot waste gas 32 before the thinning of the air/oil mixture 40, without a mixture of the hot waste gas 32 with the fresh air 36 occurring. The influence of the fresh air 36 (and therefore of the air/oil mixture 40) increases an efficiency of the entire device for fixing the print image.

A slight negative pressure advantageously prevails in the drying chamber 22. This has the effect that air is taken in at the slits of the drying chamber 20 through which the recording material 22 is moved into or out of the drying chamber 20. So that an approximately constant air pressure predominates in the drying chamber 20, approximately 1.5 times the amount of air/oil mixture 40 must therefore be discharged via the gas outlet 38 in the comparison to the supplied fresh air 38.

Figure 6:
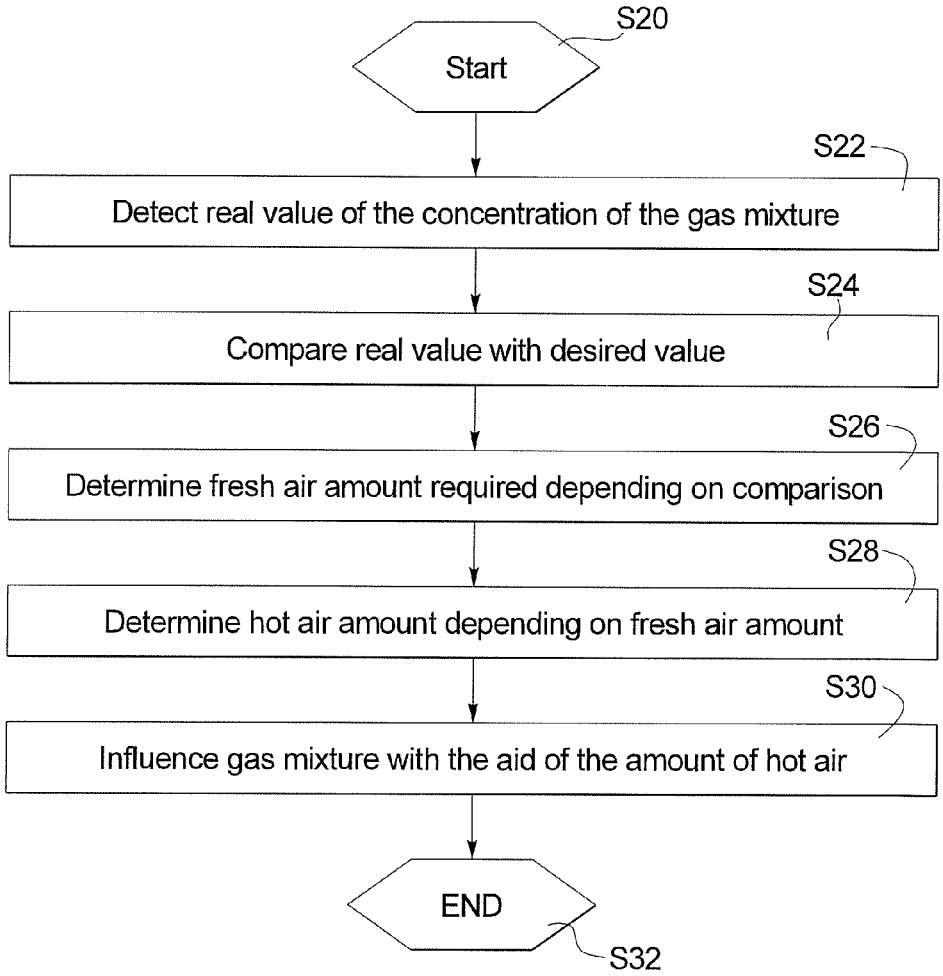
FIG. 6 is a workflow diagram of a method to regulate the oil proportion in the air/oil mixture.

FIG. 6 shows the method to regulate the concentration of the oil portion of the air/oil mixture 40. The method serves to avoid the concentration of the oil portion of the air/oil mixture 40 becoming greater than or equal to the UEG. The method is advantageously started in Step S20.

In Step S22 a real value of the concentration of the air/oil mixture 40 is detected with the aid of the sensor device 39 and transferred to the control device 37. As an alternative or in addition to the real value of the concentration, the real value of the temperature of the air/oil mixture 40 can also be detected in Step S22.

In Step S24 the real value is compared with a predetermined desired value of the concentration or the temperature.

Depending on the comparison of the real value with the desired value, and in particular depending on a difference between the real value and the desired value, in Step S26 it is determined what amount of fresh air must be supplied to the drying chamber 20 so that the concentration of the air/oil mixture 40 does not exceed the UEG. In the event that the real value of the temperature of the air/oil mixture 40 is compared with the desired value of the temperature of the air/oil mixture 40, the desired value can, for example, be selected so that the warm air/oil mixture 40 optimally contributes to the vaporization of the carrier fluid 42, and nevertheless the temperature is not so high that an explosion risk exists.

In the event that the fresh air 36 is admixed with the hot waste gas 32 in the air mixer 52, in Step S28 it is determined—depending on the required amount of fresh air and depending on a temperature of the hot waste gas 32—how large the proportion of hot waste gas 32 to the total amount of fresh air must be so that overall exactly the required amount of fresh air is provided and the required amount of fresh air has the suitable temperature. In the event that the fresh air 36 is heated by the hot waste gas 32 with the aid of the heat exchanger 54 without mixing it with the hot waste gas 32, it is determined how much hot waste gas 32 is required to heat the fresh air so that the required amount of fresh air has the suitable temperature before the thinning of the air/oil mixture 40 has the suitable temperature.

In Step S30 the air/oil mixture 40 is influenced with the aid of the determined amount of waste gas. To influence the air/oil mixture 40 with the aid of the hot waste gas 32, the hot waste gas 32 is admixed with the fresh air 36 in the air mixer 52 (shown in FIG. 4), or the hot waste gas 32 is supplied via the waste gas discharge 30 to the heat exchanger 54 shown in FIG. 5.

The method can be ended in Step S32. This method is advantageously executed in the form of a control loop so that the concentration of the vaporized carrier fluid 48 in the air/oil mixture 40 or the temperature of the air/oil mixture 40 is regulated. It is particularly preferred to execute the method shown in the two workflow diagrams as control loops that engage in one another, in particular are dependent on one another.

The energy efficiency of the drying chamber 20 with the porous burner 24 can be even further increased in that the portion of the air/oil mixture 40 is supplied to the porous burner 24 as a fuel/air mixture 28. The portion of the air/oil mixture 40 can for example thereby be mixed with a conventional fuel/air mixture 28, for example propane or natural gas. Oil droplets of the air/oil mixture 40 are burned as fuel in the porous burner 24, whereby oil portions are removed from the air/oil mixture 40. The hot waste gas 32 that then escapes from the porous burner 24 is therefore low in emissions. In this way the air/oil mixture 40 is used as a fuel to fix the print image and is simultaneously at least partially cleaned. The air/oil mixture 40 can then be cleaned in a relatively uncomplicated method before it can be output to the environment, compared with a cleaning method in which the air/oil mixture 40 is cleaned without prior use as a fuel.

The preferred embodiment is not limited to the specified exemplary embodiments. For example, the heat exchanger 54 and/or the air mixer 52 can be arranged within the drying chamber 20. The control device 37 can also be arranged outside of the drying chamber 20. The hot waste gas 32 can also be output directly into the drying chamber 20. Only one or additional modules 25 of the porous burner 24 can also be arranged next to one another or in series in the drying chamber 20. The form of the porous burner 24—in particular its porous structure—can also be of nearly arbitrary selection. For example, multiple cross-strips of modules 25 or of porous burners 24 can be arranged in series or next to one another in the transport direction of the recording material 22, whereby a temperature profile can be realized that corresponds to a temperature profile to fix print images of conventional heating devices. The device and the method can also be used in offset printing to dry the oil-based ink that is thereby used.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

We claim:

1. A device to fix print images on a recording material, comprising:

a drying chamber;

recording material moving through the drying chamber, and a printing fluid comprising carrier fluid and chromophoric solid particles being applied on said recording material, the chromophoric solid particles being applied in a form of the print images to be fixed;

a porous burner in which a combustion reaction of a fuel reaction of a fuel/air mixture supplied to the porous burner runs into a porous structure of the porous burner and not into an open flame to generate hot waste gas and infrared radiation;

the porous burner being arranged in the drying chamber so that the infrared radiation is directed towards the recording material such that the carrier fluid of the printing fluid polymerizes or vaporizes, a gaseous air/oil mixture arising in the drying chamber, and said hot waste gas of the porous burner influencing said gaseous air/oil mixture; and an air feed feeding fresh air into the drying chamber to thin the air/oil mixture and wherein the fresh air is heated with aid of the hot waste gas of the porous burner.

2. The device according to claim 1 wherein a heat exchanger is coupled with the porous burner and the drying chamber and that, for said influencing of the air/oil mixture with aid of the hot waste gas of the porous burner, heats the air/oil mixture or the fresh air to thin the air/oil mixture.

3. The device according to claim 1 wherein an air mixer is coupled with the porous burner and the drying chamber for said influencing of the air/oil mixture in the drying chamber by mixing the air/oil mixture or fresh air with the hot waste gas to thin the air/oil mixture.

4. The device according to claim 1 wherein a sensor device is provided that detects a real value of at least one parameter of the air/oil mixture, and a control device that, with aid of the hot waste gas, influences the air/oil mixture depending on the detected real value so that the real value approximates a desired value of the parameter or corresponds to the desired value of the parameter.

5. The device according to claim 1 wherein a gas return is provided that is coupled with the drying chamber and that supplies at least a portion of the air/oil mixture of the drying chamber to the porous burner as said fuel/air mixture.

6. A method of claim 1 where the exhaust gas is fed directly into the drying chamber for said influencing of said air/oil mixture.

7. A method to fix print images on a recording material, comprising the steps of:

providing a drying chamber;

providing a recording material moving through the drying chamber, and providing a printing fluid comprising carrier fluid and chromophoric solid particles to be applied on said recording material, the chromophoric solid particles being applied in a form of the print images to be fixed;

providing a porous burner in which a combustion reaction of a fuel reaction of a fuel/air mixture supplied to the porous burner runs into a porous structure of the porous burner and not into an open flame to generate hot waste gas and infrared radiation;

arranging the porous burner in the drying chamber so that the infrared radiation is directed towards the recording material such that the carrier fluid of the printing fluid polymerizes or vaporizes, a gaseous air/oil mixture arising in the drying chamber;

influencing said gaseous air/oil mixture arising in the drying chamber by said hot waste gas of the porous burner; and feeding fresh air into the drying chamber to thin the air/oil mixture and wherein the fresh air is heated with aid of the hot waste gas of the porous burner.

8. The method according to claim 7 wherein, for said influencing of the air/oil mixture with the aid of the hot waste gas of the porous burner the air/oil mixture or the fresh air is heated to thin said air/oil mixture before supplying the hot waste gas into the drying chamber.

9. The method according to claim 7 wherein, for said influencing of the air/oil mixture, said air/oil mixture is admixed with the hot waste gas or the fresh air is admixed with the hot waste gas to thin the air/oil mixture before supplying the hot waste gas into the drying chamber.

10. The method according to claim 7 wherein a real value of at least one parameter of the air/oil mixture is detected, and, with aid of the hot waste gas of the porous burner the air/oil mixture is influenced depending on the detected real value so that the real value approximates a desired value of the parameter or corresponds to the desired value of the parameter.

11. The method according to claim 7 wherein at least a portion of the air/oil mixture of the drying chamber is supplied to the porous burner as said fuel/air mixture.

12. A method according to claim 7 where the exhaust gas is fed directly into the drying chamber for said influencing of the air/oil mixture.

13. A device to fix print images on a recording material, comprising:

a drying chamber;

recording material moving through the drying chamber, and a printing fluid comprising carrier fluid and chromophoric solid particles being applied on said recording material, the chromophoric solid particles being applied in a form of the print images to be fixed;

a porous burner in which a combustion reaction of a fuel reaction of a fuel/air mixture supplied to the porous burner runs into a porous structure of the porous burner and not into an open flame to generate hot waste gas and infrared radiation; and the porous burner being arranged in the drying chamber so that the infrared radiation is directed towards the recording material such that the carrier fluid of the printing fluid polymerizes or vaporizes, a gaseous air/oil mixture arising in the drying chamber, and said hot waste gas of the porous burner influencing said gaseous air/oil mixture.

14. A method to fix print images on a recording material, comprising the steps of:

providing a drying chamber;

providing a recording material moving through the drying chamber, and providing a printing fluid comprising carrier fluid and chromophoric solid particles to be applied on said recording material, the chromophoric solid particles being applied in a form of the print images to be fixed;

providing a porous burner in which a combustion reaction of a fuel reaction of a fuel/air mixture supplied to the porous burner runs into a porous structure of the porous burner and not into an open flame to generate hot waste gas and infrared radiation;

arranging the porous burner in the drying chamber so that the infrared radiation is directed towards the recording material such that the carrier fluid of the printing fluid polymerizes or vaporizes, a gaseous air/oil mixture arising in the drying chamber; and influencing said gaseous air/oil mixture arising in the drying chamber by said hot waste gas of the porous burner.

* * * * *